United States Patent [19]

Van Esdonk et al.

[11] 3,974,583

[45] Aug. 17, 1976

[54] PICTURE DISPLAY PANEL

[75] Inventors: Johannes Van Esdonk; Johannes Petrus Hornman; Antonius Matheus Johanna Bluekens; Mathieu Martinus Maria Petrus Mattheij, all of Eindhoven, Netherlands

[73] Assignee: U.S. Philips Corporation, New York, N.Y.

[22] Filed: Feb. 10, 1975

[21] Appl. No.: 548,436

Related U.S. Application Data

[63] Continuation of Ser. No. 382,895, July 26, 1973.

[30] Foreign Application Priority Data

Aug. 18, 1972 Netherlands ..... 7211382

[52] U.S. Cl. ..... 40/130 E; 40/134

[51] Int. Cl.[2] ..... G09F 13/20

[58] Field of Search ..... 40/134, 132, 130; 240/2.25

[56] References Cited

UNITED STATES PATENTS

| | | | |
|---|---|---|---|
| 1,157,856 | 10/1915 | Eubank | 40/130 E X |
| 1,385,778 | 7/1921 | Dodds | 240/2.25 |
| 3,728,808 | 4/1973 | Rieth | 40/130 E |

*Primary Examiner*—Louis G. Mancene
*Assistant Examiner*—Wenceslao J. Contreras
*Attorney, Agent, or Firm*—Frank R. Trifari; Carl P. Steinhauser

[57] ABSTRACT

A display panel having an intermediate plate constructed from strips in cross bond, in which luminescent and reflecting material is previously provided on the side faces of the strips.

3 Claims, 3 Drawing Figures

PICTURE DISPLAY PANEL

Figure 1:
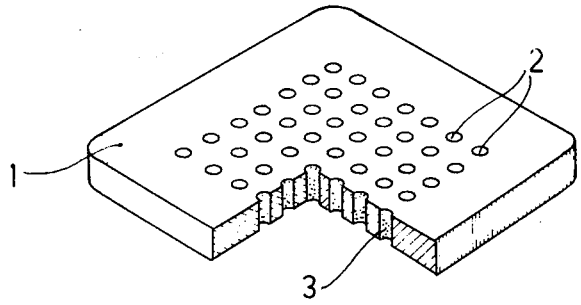

This is a continuation, of application Ser. No. 382,895, filed July 26, 1973.

The invention relates to a picture display panel comprising an insulating lower plate, a perforated intermediate plate and a light-pervious electrically insulating upper plate. The invention furthermore relates to a method of manufacturing such an apertured plate, in particular for black-and-white or colour display, in which the apertured plate is comparatively thick and is provided with luminescent and possibly reflecting material which is present on the inner wall of the apertures. Such an apertured plate may consist of insulating material or of metal which is covered at the surface with an insulating layer.

In application Ser. No. 382,896 (PHN 5338A) it is disclosed how to manufacture an apertured plate from an electrically oxidized aluminum plate. Since it was possible for the plate to be thin, the apertures could be provided by photo-chemically etching, while the oxide layer was made so thick that the thermal expansion of the plate was approximately equal to that of the upper and lower plate of the panel. In many cases, however, it is necessary to use an apertured plate having a thickness of a few millimeters, for example, if a positive column discharge is desired. Moreover, a luminescent material will often be provided in the holes for black-and-white or color display. Photo-chemical etching in such a thick plate is not possible since the holes do not obtain a constant cross-section. Drilling the holes is very cumbersome and hence expensive. Moreover, an aluminum plate cannot be used in that case since the walls between drilled holes become too thick so that adaptation of the thermal expansion by an oxide layer is no longer possible. Furthermore it is cumbersome to cover the inner wall of the holes with a luminescent material.

The above difficulties can be reduced considerably by using an apertured plate which consists, at least at the surface, of an insulating material if, according to the invention, the apertured plate is formed from a number of strips which are incised at given distances transversely thereto and are slit into each other with the incisions at an angle in such manner that they are connected together in a cross bond. Preferably, the strips are previously covered with a luminescent and possibly reflecting material at the places which are to form the inner walls of the apertures. In that case a lattice-like apertured plate is obtaining having rectangular holes. The thickness of the plate may be equal to the width of the strips and thus no longer has any influence on the method of manufacturing. It has been found that the assembly of the strips is possible in a comparatively rapid manner, also for panels having large dimensions. Since the provision of the incision in the strips and the provision of the luminescent or reflecting layers can be carried out photo-chemically, a great accuracy in the shape of the strips and thus also in the construction of the apertured plate can be obtained.

The provision of lattice-like partitions on the inner surface of an anode by means of a cross bond of strips was known from the British Patent specification 610,574, but in this case no apertured plate was formed.

Figure 2:
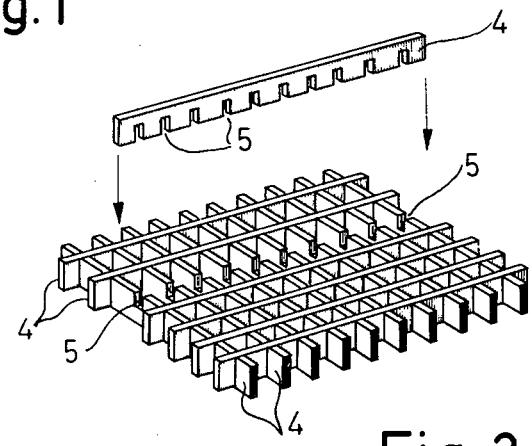
Figure 3:
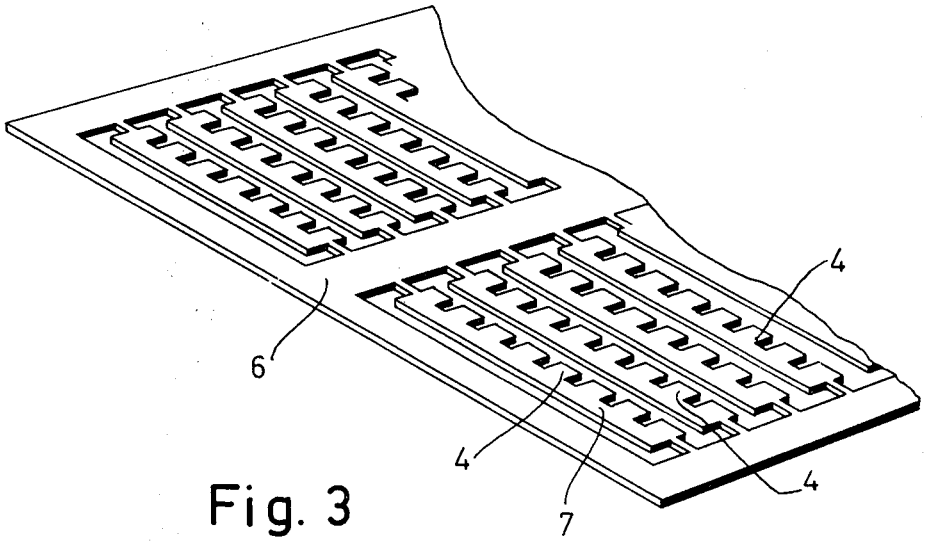

The invention will be described in greater detail with reference to an embodiment and the drawing, of which FIG. 1 shows a known apertured plate, for example of glass, FIG. 2 shows a part of a composed apertured plate according to the invention, and, FIG. 3 shows how the strips for an apertured plate shown in FIG. 2 can be obtained.

Reference numeral 1 in FIG. 1 denotes an apertured plate consisting, for example, of glass. The center distance of the apertures 2 is, for example, 1.25 mm and the diameter of the apertures is 1 mm. The inner wall of the apertures is covered with luminescent material 3. The provision of the apertures 2 in such a plate with a thickness of more than 1 mm, for example, 3 mm, is very difficult since the apertures can be provided substantially only by drilling.

According to the invention, strips 4 comprising incisions 5 the depth of which is half of the width of the strips are used.

The strips 4 are placed in each other with the incisions 5 usually at right angles so that they are connected by means of a cross bond.

The strips can be obtained from an aluminum plate 6 by photo-chemically etching (FIG. 3). After electrically oxidizing the plate 6 with strips, phosphor layers luminescing in the desired colour, may be provided on the side faces of the strips 4 either as a continuous layer or in dots. The side faces of the strips 4, after composing the apertured plate, constitute the inner walls of the apertures. For color display the phosphor faces for the desired colour may be provided on the side faces of the strips in such a manner that the faces land on two or four inner faces of the apertures. Also, in the case of color display, apertures having correspondingly colored phosphors may be placed in the picture in, for example, vertical straight lines, in which case one side face of each vertical strip can be covered entirely with a phosphor of a given colour, for example red on one side, green on the other, or green and blue, or blue and red. The side-faces covered with the same phosphor color are then placed opposite to each other. The horizontal strips then obtain no phosphor coating but are preferably covered with a light-reflecting layer.

Since the oxide layer is made so thick that the thermal expansion of the apertured plate corresponds so that of the upper and lower plates, no difficulties are experienced after the plates have been connected together at the edges in a vacuum-tight manner and thus constitute a panel.

In the strips 4 for an apertured plate 1 which comprises rectangular, in this case square, apertures of $1 \times 1$ mm$^2$, incisions 5 having a width which corresponds to the thickness of the strips 4, in this case 0.25 mm, are provided. The center distance of the incisions 5 is 1.25 mm. However, the apertures need not have a square cross-section. Furthermore, the angles between the strips need not enclose 90°, but the apertures may be rhombic.

It has been found that an apertured plate constructed from such strips as such constitutes a rigid assembly which can be readily handled. As a result of the large number of incisions, the strips do not show a tendency of working loose. Composing the apertured plate can be carried out entirely mechanically, if desired.

It would also be possible to manufacture apertured plates which are thinner than 1 mm in this manner, but the above-described method does not present any noteworthy advantages in that case.

What is claimed is:

1. A display panel comprising a first electrically insulating plate, a second light-pervious electrically insulating plate, and an apertured plate between said first and second plates, the surface of said apertured plate being covered with an electrically insulating material, said apertured plate comprising a criss-cross arrangement of strips having slots which extending transversely thereto, each strip at each cross-point thereof with another strip being positioned in a said slot in that other strip, the surfaces of said strips being provided with a phosphor layer luminescing in a desired color with alternate strips luminescing in different colors.

2. A panel as claimed in claim 1, wherein each slot has substantially the same width as the thickness of the strip positioned therein.

3. A panel as claimed in claim 1, in which said strips consist of anodically oxidized aluminum.

* * * * *